US005564132A

United States Patent [19]

Kuo

[11] Patent Number: 5,564,132

[45] Date of Patent: Oct. 15, 1996

[54] DIVING MASK WITH AN ARCUATE LENS

[76] Inventor: Kuo-yen Kuo, No. 28, Lane 196, Sec. 2, Kwangfu Rd., Sanchung City, Taipei Hsien, Taiwan

[21] Appl. No.: 491,231

[22] Filed: Jun. 16, 1995

[51] Int. Cl.[6] ..... A61F 9/02

[52] U.S. Cl. ..... 2/430; 2/441; 2/452

[58] Field of Search ..... 2/428, 429, 430, 2/441, 447, 452, 426

[56] References Cited

U.S. PATENT DOCUMENTS

| | | | |
|---|---|---|---|
| 4,648,394 | 3/1987 | Wise | 2/429 X |
| 4,724,550 | 2/1988 | Fox et al. | 2/428 |
| 4,977,627 | 12/1990 | Metcalfe et al. | 2/441 X |
| 5,345,615 | 9/1994 | Garofalo | 2/430 |

*Primary Examiner*—Peter Nerbun

*Attorney, Agent, or Firm*—Ralph F. Crandell; Holland & Hart LLP

[57] ABSTRACT

A diving mask includes an elongate arcuate frame having two rearward formed lateral sides, a strap adjustably connected to the frame, a substantially arc-shaped lens having a smooth mediate portion and two side portions and tightly coupled to a front face of the frame, and a facial skirt sealingly coupled to a rear face of the frame such that the diving mask provides a wider view to a diver and defines a more compact volume between the diver and the mask.

1 Claim, 2 Drawing Sheets

DIVING MASK WITH AN ARCUATE LENS

BACKGROUND OF THE INVENTION

1. Field of the Invention

The present invention relates generally to a underwater face mask and, more particularly, to an improved underwater diving face mask having an arcuate lens.

2. Description of Related Art

An underwater face mask is a needed equipment for activities such as skin and scuba diving. A conventional underwater face mask, as shown in FIG. 4, typically comprises a generally flat glass window 42 approximately perpendicularly to the diver's straight-ahead viewing axis, a substantially elongate rectangular frame 44 for holding the flat glass window 42 in position, a flexible facial skirt 46 sealingly attached to the frame, and a rubber strap 48 coupled to two ends for tightening the mask to the diver's face such that define a contiguous air space shared by the diver's nose and eyes.

Such conventional flat-window diving face mask has a couple of shortcomings. The first shortcoming is that the diver's view is confined to his front only because the glass of the mask is flat and two lateral sides of the mask are the lateral sides of the frame such that the diver's sideways view is obscured. The second shortcoming is that because the frame and the glass are substantially flat the two lateral side portions of the mask fail to bend toward the diver's face such that an extra space between the mask and the diver's face is thus defined and this will need more air to force out the water leaking into the mask or defog the mask glass.

The present invention provides an improved underwater diving face mask to mitigate and/or obviate the aforementioned problems.

SUMMARY OF THE INVENTION

One object of the present invention is to provide a diving mask which can provide optimum underwater viewing characteristics to a diver.

Another object of the present invention is to provide a diving mask which defines a more compact space between a diver's face and the mask and thus can be closely fitted to the diver's face.

The above objects are achieved by providing an underwater diving face mask which includes:

an elongate arcuate frame having a front face, a rear face, and two rearward formed lateral sides, the frame comprising a pair of securing buckles respectively formed at the two lateral sides, a peripheral groove formed in an inner periphery thereof, and a number of recesses defined in the groove;

an arcuate lens unit having a configuration substantially the same as that of the frame and tightly coupled to the frame from the front face of the frame, the arcuate lens unit comprising a continuous arc-shaped lens, and a border surrounding a periphery of the lens and having a number of ridge to cooperate with the recesses of the frame to tightly couple the lens unit to the frame;

a flexible facial skirt sealingly coupled to the frame from the rear face of the frame; and a rubber strap having two ends respectively and adjustably connected to the securing buckles of the frame.

In accordance with one embodiment of the present invention, the arc-shaped lens has a smooth mediate portion form between two side portions which have smoothly arc-shaped connections with the mediate portion.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
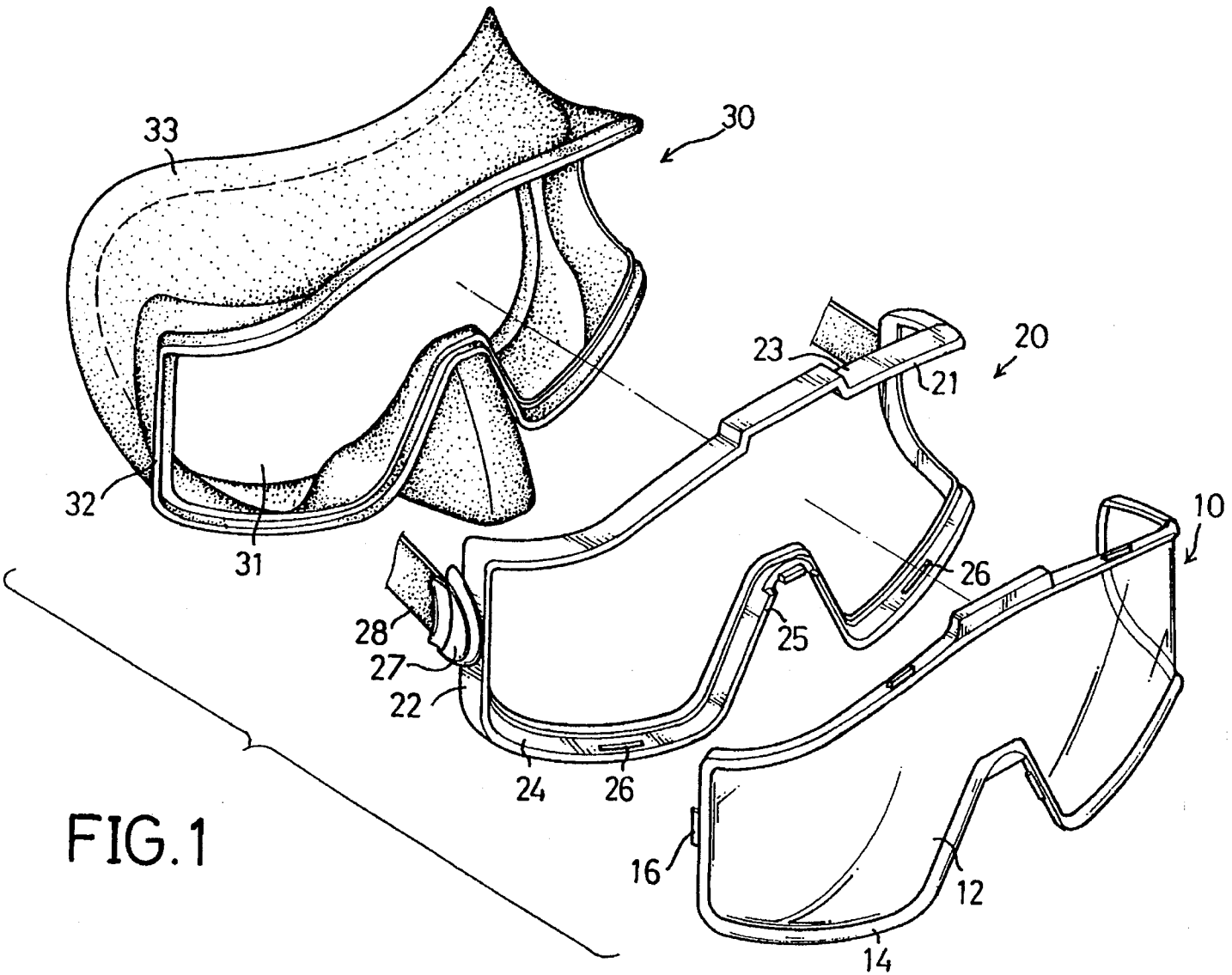
FIG. 1 is an exploded perspective view of a diving mask in accordance with the present invention.
Figure 2:
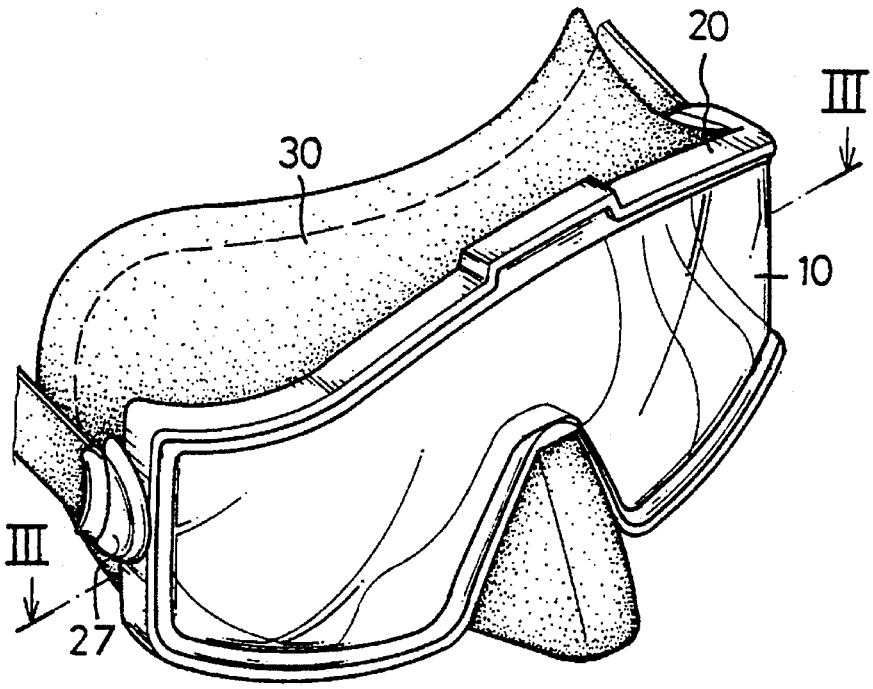
FIG. 2 is an assembled perspective view of the diving mask shown in FIG. 1.
Figure 3:
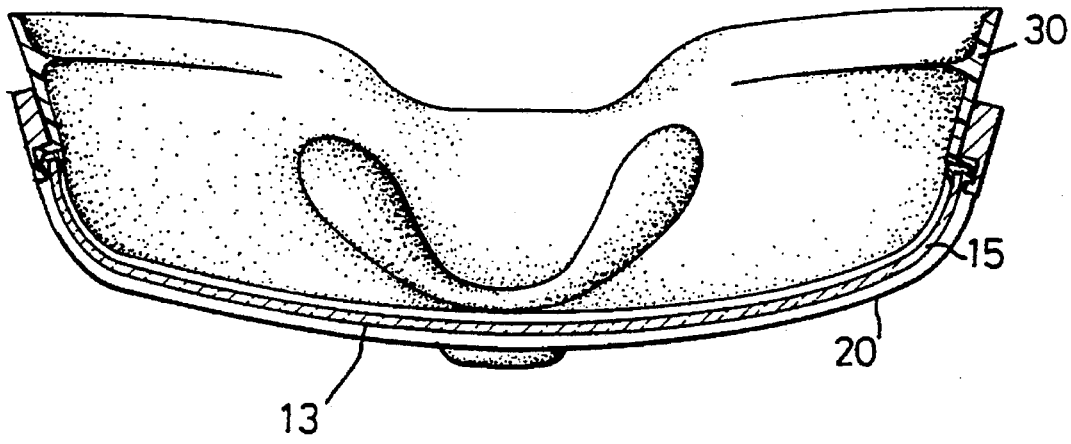
FIG. 3 is a cross-sectional view taken along line III—III of FIG. 2.

Referring now to FIGS. 1, 2 and 3, the diving mask in accordance with the present invention generally includes a lens unit 10, a frame 20, a facial skirt 30, and a strap 28. The frame 20 preferably is an elongate arcuate rectangular frame having a front face 21, a rear face 23, and two rearwardly formed lateral sides 22. The frame further comprises a pair of securing buckles 27 respectively formed at the two lateral sides 22, a peripheral groove 24 formed in an inner periphery thereof, and a number of recesses 26 defined in the groove 24. A notch 25 is formed in a lower rim of the frame 20 corresponding to a diver's nose.

The lens unit 10 has a configuration substantially the same as that of the frame 20. The lens unit 10 comprises a continuous arc-shaped lens 12, and a border 14 surrounding a periphery of the lens 12. The border 14 has a number of ridges 16 formed at an outer periphery thereof to cooperate with the recesses 26 of the frame 20 to tightly couple the lens unit 10 to the frame 20. The lens 12, preferably, has a smooth mediate portion 13 form between two side portions 15 which have smoothly arc-shaped connections with the mediate portion 13, as better shown in FIG. 2. The lens 12 is made of plastic, glass, or the like. Preferably, the lens 12 is made of tempered glass.

The flexible facial skirt 30 has a front opening 31 having a configuration substantially the same as that of the frame 20, a rear opening 33, and a nose portion 34. The front opening 31 has a peripheral lip 32 formed on a periphery thereof. The lip 32 is squeezed from the rear face 23 of the frame 20 into the groove 24 of the frame 20 to thereby sealingly attach the facial skirt 30 to the frame 20. Preferably, the flexible facial mask 30 is made out of a flexible or elastic plastic or rubber material such as silicone, neoprene, or the like.

The rubber strap 28 has two ends respectively and adjustably connected to the securing buckles 27 of the frame 20 to adjustably secure the diving mask to the diver's face and thus define a more compact contiguous space over both the diver's nose and eyes.

Although the invention has been explained in relation to its preferred embodiment, it is to be understood that many other possible modifications and variations can be made without departing from the spirit and scope of the invention as hereinafter claimed.

I claim:

1. A diving mask comprising:

an elongate arcuate frame having a front face, a rear face, and two rearward formed lateral sides, said frame comprising a pair of securing buckles respectively formed at said two lateral sides, a peripheral groove formed in an inner periphery of said frame, and a number of recesses defined in said groove;

an arcuate lens unit having a configuration substantially the same as that of said frame and tightly coupled to said frame from the front face of said frame, said arcuate lens unit comprising a continuous arc-shaped lens having a smooth mediate portion form between two side portions which have smoothly arc-shaped connections with said mediate portion, and a border surrounding a periphery of said lens unit and having a number of ridges to cooperate with the recesses of said frame to tightly couple said lens unit to said frame;

a flexible facial skirt;

means for sealingly coupling said skirt to said frame from the rear face of said frame; and a rubber strap having two ends respectively and adjustably connected to said securing buckles of said frame.

* * * * *

UNITED STATES PATENT AND TRADEMARK OFFICE

CERTIFICATE OF CORRECTION

PATENT NO. : 5,564,132
DATED : October 15, 1996
INVENTOR(S) : Kuo-Yen Kuo

Figure 4:
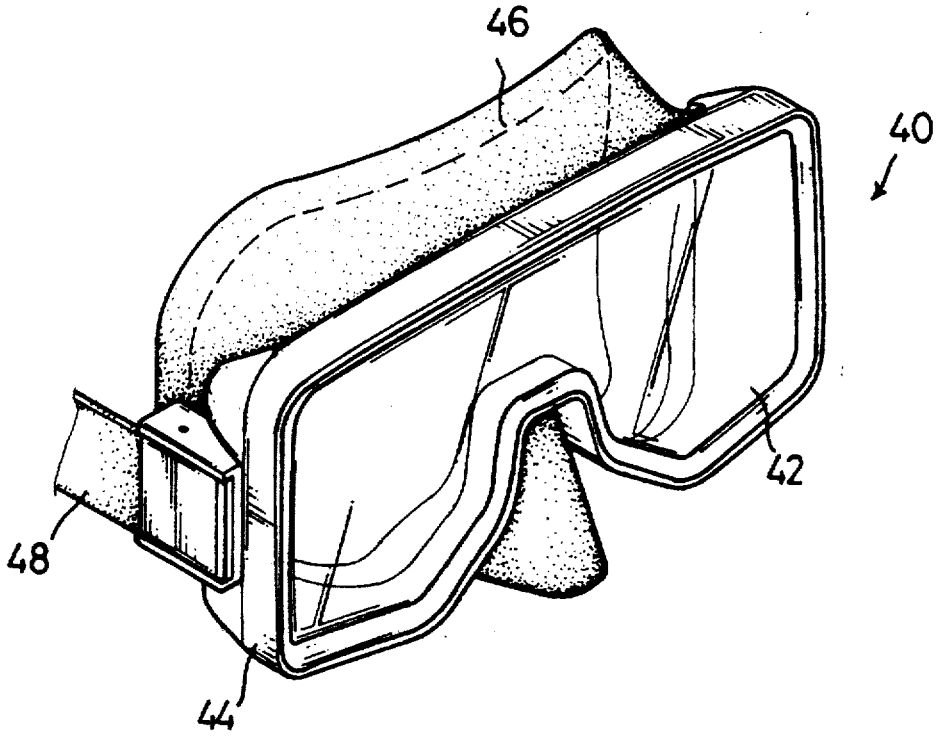
FIG. 4 PRIOR ART
FIG. 4 is a perspective view of a conventional diving mask.

It is certified that error appears in the above-identified patent and that said Letters Patent is hereby corrected as shown below:

Drawings:

Add the Drawing Sheet , consisting of Fig. 4 as shown on the attached page.

Signed and Sealed this

Seventeenth Day of February, 1998

*Attest:*

Bruce Lehman

BRUCE LEHMAN

*Attesting Officer*

*Commissioner of Patents and Trademarks*